US008007642B2

(12) United States Patent
Caro et al.

(10) Patent No.: US 8,007,642 B2
(45) **Date of Patent: *Aug. 30, 2011**

(54) ELECTROCHEMICAL GAS GENERATOR FOR COMBUSTIBLE GASES

(75) Inventors: Kerstin Caro, Timmendorfer Strand (DE); Peter Tschuncky, Lübeck (DE); Herbert Kiesele, Lübeck (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 1049 days.

This patent is subject to a terminal disclaimer.

(21) Appl. No.: 11/839,071

(22) Filed: Aug. 15, 2007

(65) Prior Publication Data

US 2008/0078671 A1 Apr. 3, 2008

(30) Foreign Application Priority Data

Sep. 29, 2006 (DE) ..... 10 2006 046 464

(51) Int. Cl.
*C25B 9/00* (2006.01)
*C25B 1/00* (2006.01)

(52) U.S. Cl. ..... 204/230.2; 204/230.5; 204/266

(58) Field of Classification Search ..... None
See application file for complete search history.

(56) References Cited

U.S. PATENT DOCUMENTS 3,531,387 A 9/1970 Cyba et al.
5,395,501 A 3/1995 Rohrbacker et al.
5,968,325 A * 10/1999 Oloman et al. ..... 204/230.5
6,387,228 B1 * 5/2002 Maget ..... 204/230.2
6,780,304 B1 * 8/2004 Maget ..... 205/555
7,316,857 B1 * 1/2008 Swanson et al. ..... 429/421
2005/0262924 A1 12/2005 Wood et al.
2006/0283707 A1 * 12/2006 Kuhn ..... 204/424

FOREIGN PATENT DOCUMENTS

DE 102005028246 A1 12/2006
GB 2 441 049 2/2008

OTHER PUBLICATIONS

R. Doeling, Potentiostats, Mar. 2000, retrieved from http://www.bank-ic.de/encms/downloads/potstae2.pdf.*

Gore Excellerator Gas Diffusion Membranes Product Data Sheet, 2003.*

J. Schäfer, CC-Verknüpfungen an Anode und Kathode, Angew. Chemie 1981, 93, 978-988, ISSN 0044-8249.

* cited by examiner

*Primary Examiner* — Harry D Wilkins, III
(74) *Attorney, Agent, or Firm* — McGlew and Tuttle, P.C.

(57) ABSTRACT

An electrochemical gas generator is provided with an electrolysis cell (1) with a housing, which is closed by a gas-permeable membrane (2) for the escape of the test or calibrating gas. A cathode (5) is provided formed of a noble metal, a mixture of noble metals or a material containing carbon. The cathode is in direct contact with an electrolyte (7) disposed in the housing. An anode (4) is provided formed of a noble metal, a mixture of noble metals or a material containing carbon. The anode is in direct contact with an electrolyte (7). The electrolyte (7) contains a carboxylic acid salt. A control unit (6) is provided that acts as a current source and which is connected to the electrodes (4, 5).

20 Claims, 1 Drawing Sheet

ELECTROCHEMICAL GAS GENERATOR FOR COMBUSTIBLE GASES

CROSS REFERENCE TO RELATED APPLICATIONS

This application claims the benefit of priority under 35 U.S.C. §119 of German Patent Application DE10 2006 046 464.8 filed Sep. 29, 2006, the entire contents of which are incorporated herein by reference.

FIELD OF THE INVENTION

The present invention pertains to an electrochemical gas generator for ethane.

BACKGROUND OF THE INVENTION

To test the function or to calibrate gas sensors, the gas to be measured or a substitute gas that appears to be suitable is admitted, in general, to the gas sensors at fixed time intervals. Either test gas in pressurized gas containers may be used for this together with suitable gas admission means, for example, with pressure reducers, or the test gas may be generated directly and applied to the sensor by means of suitable gas admission devices. The use of pressurized containers with corresponding means is complicated and requires corresponding logistics and handling. To make matters worse, especially in case of the calibration of detectors for combustible gases in the explosive range, potentially explosive gas mixtures must be handled within explosion-proof areas.

It is therefore advantageous for testing the function of sensors for combustible and explosive gases, e.g., of pellistors or IR sensors, to generate the test gas in a quantity sufficient for the testing in the immediate vicinity of the sensor. For example, the release of gas by heating suitable storage materials (US 2005 0 262 924) may be used for this, but this release necessitates an additional heating element, which represents an additional source of hazard in an explosion-proof area. By contrast, electrochemical gas generators offer the intrinsic advantage of inherent safety. When using electrochemical gas generators, it seams most feasible to switch over to a substitute gas calibration with hydrogen ($H_2$), because this gas can be obtained in a simple manner by the electrolysis of protic electrolytes. However, one drawback of this process is that it is not possible to obtain direct information on the sensitivity of the gas sensor to be tested to the primary analyte because the reaction of $H_2$ can be very successful on a partially poisoned catalytic material of a corresponding gas sensor, which is not longer suitable for the measurement of combustible hydrocarbons, e.g. alkanes or alkenes, i.e., the calibration is insufficient and erroneous.

SUMMARY OF THE INVENTION

Consequently, it is an object of the invention to provide an electrochemical gas generator with the highest possible long-term stability for combustible hydrocarbons, preferably alkanes or alkenes.

According to the invention, this object is achieved with an electrochemical gas generator comprising an electrolysis cell with a housing closed by a gas-permeable membrane to allow for the escape of a test or a calibrating gas. An electrolyte is provided, in the housing, further containing a carboxylic acid salt. A cathode is formed of one or more of a noble metal, a mixture of noble metals and a material containing carbon. The cathode is in direct contact with the electrolyte. An anode is formed of one or more of a noble metal, a mixture of noble metals, and a material containing carbon. The anode is in direct contact with the electrolyte. A control unit acting as a power source is connected to the cathode and the anode.

A reference electrode may also be provided in the electrolysis cell in contact with the electrolyte.

The control unit may include a potentiostat or alternatively a current source.

The cathode and the anode advantageously may include platinum and the anode advantageously may comprise a mesh structure.

The substance reacted at the anode may be at least one of acetic acid, an alkali metal salt, an alkaline earth metal salt and an ammonium salt of acetic acid and advantageously may be potassium acetate. Another reaction at the anode may be carried out analogously using at least one of a dicarboxylic acid, an alkali metal salt, an alkaline earth metal salt and an ammonium salt of dicarboxylic acid. Thus, the substance reacted at the anode advantageously may be the sodium salt of succinic acid, sodium succinate.

A substance reacted at the anode may be provided in the form of a molding placed on the anode or in the form of a structure compressed around the anode.

The electrolyte may advantageously comprise a substance in which the carboxylic acid compound used is poorly soluble. The electrolyte may be an organic electrolyte formed of a mixture of propylene carbonate and ethylene carbonate. The electrolyte may also comprise a room temperature ionic liquid like imidazolium salts.

The test or calibrating gas ethane may be formed by decarboxylation from an acetic acid compound at the anode.

The anode may consist of platinum with a mesh structure. The molding with contacting platinum mesh forming the anode advantageously may directly adjoin the membrane.

The housing of the electrolysis cell may consist of a chemically inert polymer. The housing of the electrolysis cell may also comprise one or more of polypropylene and/or polypropylene. The membrane may consist of a microporous perfluorinated polymer.

It was found that ethane can be produced at the anode of a gas generator and used to calibrate a sensor by the suitable electrolysis of carboxylic acid salts and especially of acetate solutions by decarboxylation, i.e., according to the mechanism of the Kolbe electrolysis. The $CO_2$ formed at the same time is not disturbing in the case of the sensor to be tested because there is no cross sensitivity in this respect. Gaseous ethene can be obtained besides $CO_2$ in an analogous reaction from succinic acid salts, e.g., disodium succinate.

An exemplary embodiment of the present invention will be explained below with reference to the figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
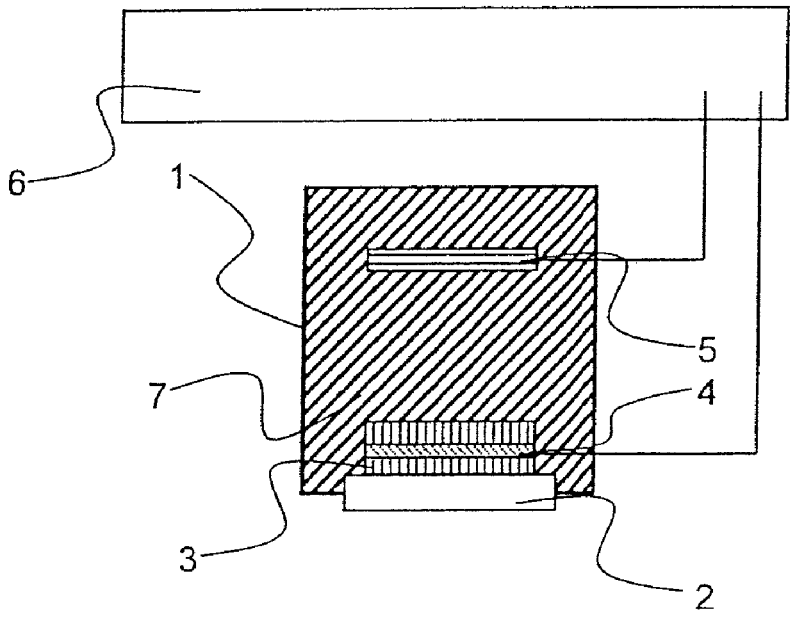
FIG. 1 is a schematic view showing an electrochemical gas generator for producing ethane, with the view showing the most important components.
Figure 2:
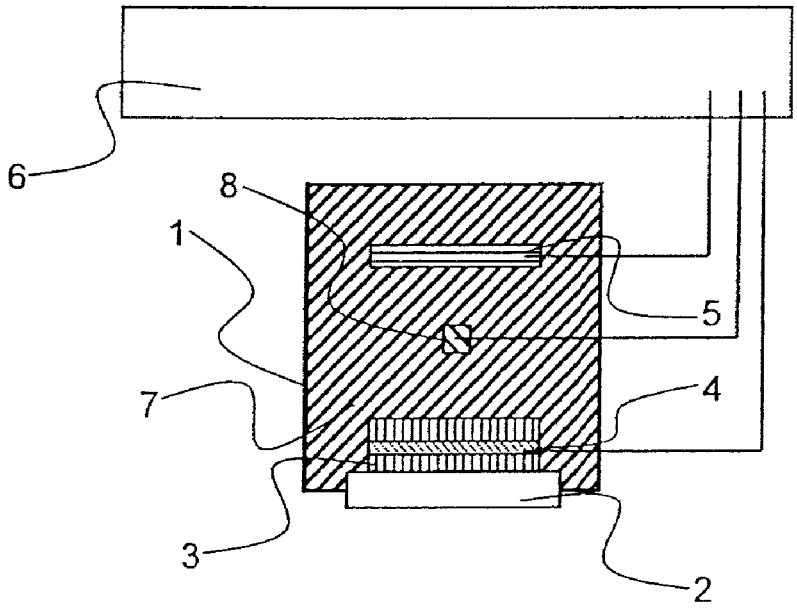
FIG. 2 is a schematic view showing an alternative design of a gas generator for the same test gas.

Referring to the drawings in particular, an exemplary embodiment of the present invention will be explained below for a gas generator producing ethane by means of FIG. 1, which schematically shows an electrochemical gas generator with the most important components. An alternative design of a gas generator for the same test gas is shown in FIG. 2. Generators of a completely analogous design are used to produce the test gas ethene with succinic acid salts instead of the acetates.

A molding 3 consisting of potassium acetate is reacted electrochemically by means of a platinum mesh connected as an anode 4 in an electrolysis cell 1 with a housing, which is closed by a gas-permeable membrane 2. A platinum electrode is likewise preferably used as the cathode 5. The electrodes 4, 5 are connected to a control unit 6, which may be connected as a potentiostat, but is preferably used as a current source. If electrolysis is carried out now, the following reactions take place at the anode 4:

Anode:

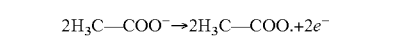

$$2H_3C—COO^- \rightarrow 2H_3C—COO. + 2e^-$$

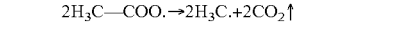

$$2H_3C—COO. \rightarrow 2H_3C. + 2CO_2\uparrow$$

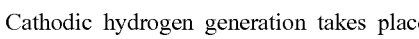

$$2H_3C. \rightarrow H_3C—CH_3\uparrow$$

Cathodic hydrogen generation takes place when aqueous electrolyte systems are used.

Cathode:

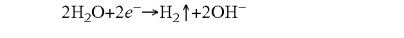

$$2H_2O + 2e^- \rightarrow H_2\uparrow + 2OH^-$$

The ethane/$CO_2$ mixture formed at the anode 4 leaves the housing of the electrolysis cell 1 through the permeable membrane 2 and can be used as a test or calibrating gas for gas generators, which are in connection with the test gas or calibrating gas.

FIG. 2 shows another design according to the present invention of the gas generator for ethane. A reference electrode 8 is additionally introduced into the electrolysis cell in direct contact with the electrolyte and is likewise connected to the control unit 6.

While specific embodiments of the invention have been shown and described in detail to illustrate the application of the principles of the invention, it will be understood that the invention may be embodied otherwise without departing from such principles.

What is claimed is:

1. An electrochemical gas generator comprising:

an electrolysis cell with a housing closed by a gas-permeable membrane to allow for the escape of a test or a calibrating gas;

an electrolyte containing a carboxylic acid salt, said electrolyte being in said housing;

a cathode formed of one or more of a noble metal, a mixture of noble metals and a material containing carbon, said cathode being in direct contact with said electrolyte;

an anode formed of one or more of a noble metal, a mixture of noble metals, and a material containing carbon, said anode being in direct contact with said electrolyte; and a control unit acting as a current source, said control unit being connected to said cathode and said anode, wherein a substance reacted at said anode is potassium acetate.

2. An electrochemical gas generator in accordance with claim 1, further comprising:

a reference electrode present in said electrolysis cell in contact with said electrolyte.

3. An electrochemical gas generator in accordance with claim 1, wherein said control unit includes a potentiostat.

4. An electrochemical gas generator in accordance with claim 1, wherein both said cathode and said anode include platinum and said anode comprises a mesh structure.

5. An electrochemical gas generator in accordance with claim 1, wherein said substance is in the form of a molding placed on said anode or in the form of a structure compressed around said anode.

6. An electrochemical gas generator in accordance with claim 5, wherein said anode comprises platinum with a mesh structure; and said molding with contacting platinum mesh of said anode directly adjoins said membrane.

7. An electrochemical gas generator in accordance with claim 1, wherein said electrolyte comprises a substance in which the carboxylic acid compound used is poorly soluble.

8. An electrochemical gas generator in accordance with claim 1, wherein said electrolyte is an organic electrolyte formed of a mixture of propylene carbonate and ethylene carbonate.

9. An electrochemical gas generator in accordance with claim 1, wherein said electrolyte comprises a room temperature ionic liquid including imidazolium salts.

10. An electrochemical gas generator in accordance with claim 1, wherein the test or calibrating gas ethane is formed by decarboxylation from a carboxylic acid compound at said anode.

11. An electrochemical gas generator in accordance with claim 1, wherein the housing of said electrolysis cell consists of a chemically inert polymer.

12. An electrochemical gas generator in accordance with claim 1, wherein the housing of said electrolysis cell comprises polypropylene.

13. An electrochemical gas generator in accordance with claim 1, wherein said membrane consists of a microporous perfluorinated polymer.

14. An electrochemical gas generator comprising:

a gas impermeable housing with an opening;

a gas-permeable membrane closing said opening, said gas-permeable membrane allowing for the release of a test gas or a calibrating gas;

an electrolyte containing a carboxylic acid salt, said electrolyte being in said housing;

a cathode consisting of one or more of a noble metal, a mixture of noble metals and a material containing carbon, said cathode being in direct contact with said electrolyte;

an anode consisting of one or more of a noble metal, a mixture of noble metals, and a material containing carbon, said anode being in direct contact with said electrolyte;

a control unit with electrical connections to said cathode and said anode for supplying current to said cathode and said anode in a controlled manner for a controlled generation of a test gas or a calibrating gas; and a substance reacted at said anode, said substance being in the form of a molding placed on said anode or in the form of a structure compressed around said anode wherein:

said control unit includes a potentiostat;

both said cathode and said anode include platinum and said anode comprises a mesh structure; and said molding with contacting platinum mesh of said anode directly adjoins said membrane.

15. An electrochemical gas generator in accordance with claim 14, further comprising:

a reference electrode present in said electrolysis cell in contact with said electrolyte.

16. An electrochemical gas generator comprising:

an electrolysis cell with a housing closed by a gas-permeable membrane to allow for the escape of a test or a calibrating gas;

an electrolyte containing a carboxylic acid salt, said electrolyte being in said housing;

a cathode formed of one or more of a noble metal, a mixture of noble metals and a material containing carbon, said cathode being in direct contact with said electrolyte;

an anode formed of one or more of a noble metal, a mixture of noble metals, and a material containing carbon, said anode being in direct contact with said electrolyte;

a control unit acting as a current source, said control unit being connected to said cathode and said anode; and a substance reacted at said anode, said substance being in the form of a molding placed on said anode or in the form of a structure compressed around said anode.

17. An electrochemical gas generator in accordance with claim 16, wherein:

said anode comprises platinum with a mesh structure; and said molding with contacting platinum mesh of said anode directly adjoins said membrane.

18. An electrochemical gas generator comprising:

an electrolysis cell with a housing closed by a gas-permeable membrane to allow for the escape of a test or a calibrating gas;

an electrolyte containing a carboxylic acid salt, said electrolyte being in said housing, said electrolyte comprising a substance in which the carboxylic acid compound used is poorly soluble;

a cathode formed of one or more of a noble metal, a mixture of noble metals and a material containing carbon, said cathode being in direct contact with said electrolyte;

an anode formed of one or more of a noble metal, a mixture of noble metals, and a material containing carbon, said anode being in direct contact with said electrolyte; and a control unit acting as a current source, said control unit being connected to said cathode and said anode.

19. An electrochemical gas generator comprising:

an electrolysis cell with a housing closed by a gas-permeable membrane to allow for the escape of a test or a calibrating gas;

an electrolyte containing a carboxylic acid salt, said electrolyte being in said housing, said electrolyte being an organic electrolyte formed of a mixture of propylene carbonate and ethylene carbonate;

a cathode formed of one or more of a noble metal, a mixture of noble metals and a material containing carbon, said cathode being in direct contact with said electrolyte;

an anode formed of one or more of a noble metal, a mixture of noble metals, and a material containing carbon, said anode being in direct contact with said electrolyte; and a control unit acting as a current source, said control unit being connected to said cathode and said anode.

20. An electrochemical gas generator comprising:

an electrolysis cell with a housing closed by a gas-permeable membrane to allow for the escape of a test or a calibrating gas;

an electrolyte containing a carboxylic acid salt, said electrolyte being in said housing, said electrolyte comprising a room temperature ionic liquid including imidazolium salts;

a cathode formed of one or more of a noble metal, a mixture of noble metals and a material containing carbon, said cathode being in direct contact with said electrolyte;

an anode formed of one or more of a noble metal, a mixture of noble metals, and a material containing carbon, said anode being in direct contact with said electrolyte; and a control unit acting as a current source, said control unit being connected to said cathode and said anode.

* * * * *